US007094142B1

(12) United States Patent
Maskell

(10) Patent No.: US 7,094,142 B1
(45) Date of Patent: Aug. 22, 2006

(54) PORTABLE DEVICE WITH INTERCHANGEABLE AIR CLEANING MODULES FOR CLEANING THE AIR OUTSIDE OF AN EXISTING ENCLOSED SPACE AND DELIVERING THE CLEANED AIR INTO THE EXISTING ENCLOSED SPACE

(76) Inventor: Thomas Joseph Maskell, 2585 Spitler Rd., Poland, OH (US) 44514

( * ) Notice: Subject to any disclaimer, the term of this patent is extended or adjusted under 35 U.S.C. 154(b) by 249 days.

(21) Appl. No.: 10/781,242

(22) Filed: Feb. 18, 2004

Related U.S. Application Data

(60) Provisional application No. 60/449,943, filed on Feb. 25, 2003.

(51) Int. Cl.
*F24F 7/007* (2006.01)

(52) U.S. Cl. ..... 454/251; 454/196

(58) Field of Classification Search ..... 454/196, 454/251, 255, 337, 338
See application file for complete search history.

(56) References Cited

U.S. PATENT DOCUMENTS

| | | | | | |
|---|---|---|---|---|---|
| 3,926,099 | A | * | 12/1975 | Grunenwald | 454/136 |
| 4,756,728 | A | * | 7/1988 | Conrad | 55/385.2 |
| 4,902,315 | A | * | 2/1990 | Spicer | 95/273 |
| 5,031,516 | A | * | 7/1991 | Jacobson | 454/195 |
| 5,063,835 | A | | 11/1991 | Rockx | |
| 5,215,499 | A | * | 6/1993 | Eberhardt | 454/256 |
| 5,225,167 | A | * | 7/1993 | Wetzel | 96/224 |
| 5,385,505 | A | | 1/1995 | Sharp et al. | |
| 5,564,980 | A | * | 10/1996 | Becker | 454/252 |
| 5,702,296 | A | * | 12/1997 | Grano | 454/200 |
| 5,720,658 | A | * | 2/1998 | Belusa | 454/238 |
| 5,725,426 | A | * | 3/1998 | Alvarez | 454/187 |
| 5,772,501 | A | * | 6/1998 | Merry et al. | 454/256 |
| 5,791,983 | A | * | 8/1998 | Robertson | 454/229 |
| 5,884,865 | A | * | 3/1999 | Scherer et al. | 244/129.3 |
| 6,071,189 | A | * | 6/2000 | Blalock | 454/236 |
| 6,287,191 | B1 | * | 9/2001 | Barker, II. | 454/248 |
| 6,484,524 | B1 | * | 11/2002 | Ulanov | 62/263 |
| 6,564,512 | B1 | * | 5/2003 | Whittemore | 52/37 |
| 6,666,910 | B1 | * | 12/2003 | Burkhart | 95/286 |
| 6,777,355 | B1 | * | 8/2004 | Kisakibaru et al. | 438/800 |
| 6,821,310 | B1 | * | 11/2004 | Hedstrom | 55/356 |

* cited by examiner

*Primary Examiner*—Derek S. Boles

(57) ABSTRACT

A portable device that is placed between the ambient air outside an existing enclosed space and the existing enclosed space that pulls the ambient air through an interchangeable array of air cleaning modules and delivers the cleaned air from the air cleaning modules into the existing enclosed space. The air cleaning modules are disposed outside the existing enclosed space so that only cleaned air is drawn into the existing enclosed space. The air cleaning modules can also be capped for easy and safe disposal after use. The air cleaning modules are in fluid communication with an electric fan that is disposed inside the existing enclosed space through an air flow inlet that is part of an expandable window insert. Accordingly, the cleaned air delivered to the existing enclosed space provides its inhabitants with clean breathable air and increases the air pressure in the existing enclosed space which prevents contaminated air from the external environment from entering the existing enclose space. The portable device consists of at least one air filtering module (46), a window insert assembly (45), an air flow conduit (48), and an electric fan (49) all of which can be easily and quickly assembled and fitted to the window of a house, apartment, office or building.

9 Claims, 4 Drawing Sheets

Exterior View

Interior View

Section View C-C

PORTABLE DEVICE WITH INTERCHANGEABLE AIR CLEANING MODULES FOR CLEANING THE AIR OUTSIDE OF AN EXISTING ENCLOSED SPACE AND DELIVERING THE CLEANED AIR INTO THE EXISTING ENCLOSED SPACE

CROSS-REFERENCE TO RELATED APPLICATIONS

This application claims the benefit of Provisional Patent Application Ser. No. 60/449,943 filed 2003 Feb. 25.

FEDERALLY SPONSORED RESEARCH

Not Applicable

SEQUENCE LISTING OR PROGRAM

Not Applicable

BACKGROUND OF THE INVENTION

1. Field of Invention

This invention relates to device that provides a continuous flow of clean, breathable air to an enclosed space.

2. Background of the Invention

Terrorists have begun to threaten mass destruction. Their attacks include biological, chemical and radiological weapons. They seek to inflict maximum damage by detonating these weapons in highly populated areas. Because air can quickly spread these lethal payloads, people would become victims in their homes and work places. There is a need to protect individuals and groups from this threat.

The Office of Homeland Security suggested that families retreat to a designated room. This room would be sealed with Duct tape. The tape would prevent contaminated air from entering it. This defense was quickly discredited for two reasons. First, it was unlikely that the room could be totally sealed. There would be leakage points missed such as those illustrated in FIG. 1. Second, if the room was successfully sealed, the occupants would soon be without oxygen.

Another defense is to place an air purifier or air filter in the room. But these devices only clean the air after it has entered the room. The purifiers and filters will eventually clean the air, but not before the occupants are exposed. Also, if the air pressure within the room is lower than the air pressure outside the room, contaminated air would flow into the room. Air cleaners do not add air to the room. They do not prevent this inflow of contaminated air. Finally, purifiers and filters are not effective against a full range of contaminates. Mechanical and electronic filters are effective with particulate materials but have little or no effect on bacteria and chemicals. Gas phase filters are needed for chemicals. Still other mechanisms, such as ultra-violet light, are used in purifiers which target bacteria and viruses. There is no single system that rids the air of all contaminates.

Air conditioners are similar to air filters in that they simply recirculate existing air within a room. While many contain air filters, their primary function is to cool the air, not clean it. Therefore, air conditioners would be even less effective at protecting occupants from air-borne contaminates than air cleaners or air filters.

Another defense is to build a clean-room. Clean-rooms have been used in the medical, chemical and electronics industries. In the medical and chemical industries, clean-rooms are usually designed to prevent chemical fumes and biological agents from escaping the work space. In the electronics industry, the reverse is often true. There the clean-rooms are designed to prevent outside air from contaminating the enclosed work space.

These industrial clean-rooms achieve their objective by providing a hermetically sealed room. Attached to this room is an air flow system capable of moving air in and out of the room. The air flow system is designed to clean the air of any contaminates. By balancing the inflow and outflow of air, the air flow system maintains the room at a desired pressure level and cleanliness. Ludwig G. Rockx (U.S. Pat. No. 5,063,835, Nov. 12, 1991) described the construction of an industrial clean-room. Gordon P. Sharp, et. al. (U.S. Pat. No. 5,385,505, Jan. 31, 1995) describes a mechanism for controlling the air flows in and out of an industrial clean-room.

These industrial units are effective at maintaining a clean enclosed space. Unfortunately, they are not easily adapted to the residential or office work environment. Hermetically sealed spaces could be built in new private residences or offices, but they would be very costly. In existing units, it would be both costly and difficult.

Additionally, the cost of the ventilation system required to support these clean-rooms is high. Air flow systems like those described in U.S. Pat. No. 5,385,505 are expensive, usually dedicated to specific contaminates, and require highly skilled maintenance personnel. These systems are not easily or economically transferred from the industrial sector to home use.

Presently, there is no air cleaning system that can be economically and effectively installed in a residential or office space. The existing air cleaning systems suffer from one or more the following deficiencies and disadvantages:

a) They fail to prevent exterior air from seeping into the enclosed space or room.
b) They fail to compensate for pressure differentials between the enclosed space and the air outside the enclosed space.
c) They fail to provide the flexibility to respond to several different air-borne contaminates.
d) They fail to provide a means to safely maintain the system after use.
e) They fail to provide for a economical installation.
f) They are not portable.
g) They are not quickly and easily installed.
h) They require expertise to install, operate, and maintain.

OBJECTS AND ADVANTAGES

Accordingly, several objects and advantages of the present invention are:

a) to provide a device that will effectively prevent contaminated air from outside an enclosed space from entering the enclosed space;
b) to provide a device that will effectively compensate for pressure differentials that develop between the enclosed space and the exterior environment;
c) to provide a device that can be designed to protect against several different air-borne contaminates;
d) to provide a device that allows the user to safely dispose of contaminated filters after their use;
e) to provide a device that is economical to purchase and to install in existing enclosed spaces;
f) to provide a device that can be easily moved from one enclosed space to another enclosed space;
g) to provide a device that can be quickly installed as needed; and h) to provide a device that can be installed, operated and maintained by unskilled residents or occupants of the enclosed space.

SUMMARY

In accordance with the present invention, a portable device that is quickly and easily installed in an existing room. The device can pressurize the room with clean, breathable air such that the increased pressure in the room prevents the contaminated air of the external environment from entering the room. Additionally, its modular cleaning mechanisms can remove a variety of contaminates from the air. This modular design also allows the safe disposal of the contaminated modules after use.

DRAWINGS—FIGURES

FIG. 1 is a drawing of an enclosed residential or office space illustrating potential points where external air can enter the enclosed space.

FIG. 2*a* is a drawing of the outside wall of a room where the room air-cleaner and pressurizing device has been installed using a window as the temporary installation point.

FIG. 2*b* is a drawing of the inside wall of a room where the room air-cleaner and pressurizing device has been installed using a window as the temporary installation point.

FIG. 2*c* is a cross sectional view of the room where the room air-cleaner and pressurizing device has been installed using a window as the temporary installation point.

Figure 7:
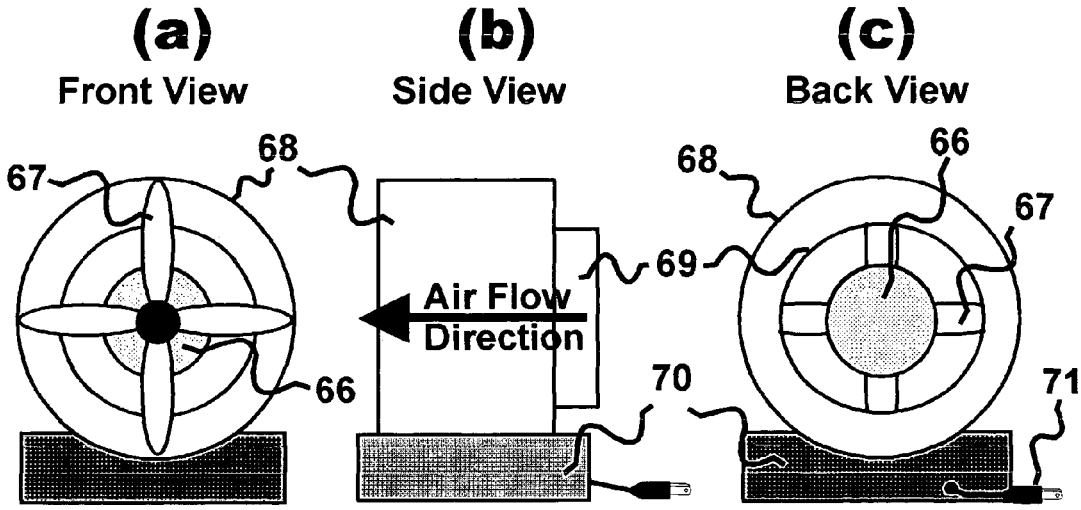

FIGS. 7*a*, 7*b* and 7*c* are drawings of the fan with a battery backup used in the room air-cleaner and pressurizing device.

DRAWINGS—REFERENCE NUMERALS

31 Wall to ceiling joints
32 Ceiling light fixture
33 Seams between plaster boards
34 Ventilation vents
35 Cracks
36 Wall to wall joints
37 Windows
38 Electrical outlets
39 Door knobs and latches
40 Heating vents
41 Wall to floor joints
42 Under doors
43 Electrical switches
44 Around door jams
45 Window insert assembly
46 Filter module
47 Exterior wall
48 Air flow conduit
49 Electric fan
50 Interior walls
51 Interior ceiling
52 Floor
53 Adjustable panel
54 Air Flow Direction
55 Air inlet
55 Air inlet
57 Interior coupling vent
58 Exterior connector
59 Gasket
60 Female-threaded connector
61 Male-threaded connector
62 Filter module cap
63 Air tight housing
64 Filter mechanism or media
65 Interior container wall
66 Drive mechanism
67 Fan blades
68 Fan housing
69 Fan inlet connector
70 Battery
71 Electrical cord and plug

DRAWINGS—DETAILED DESCRIPTION

Figure 1:
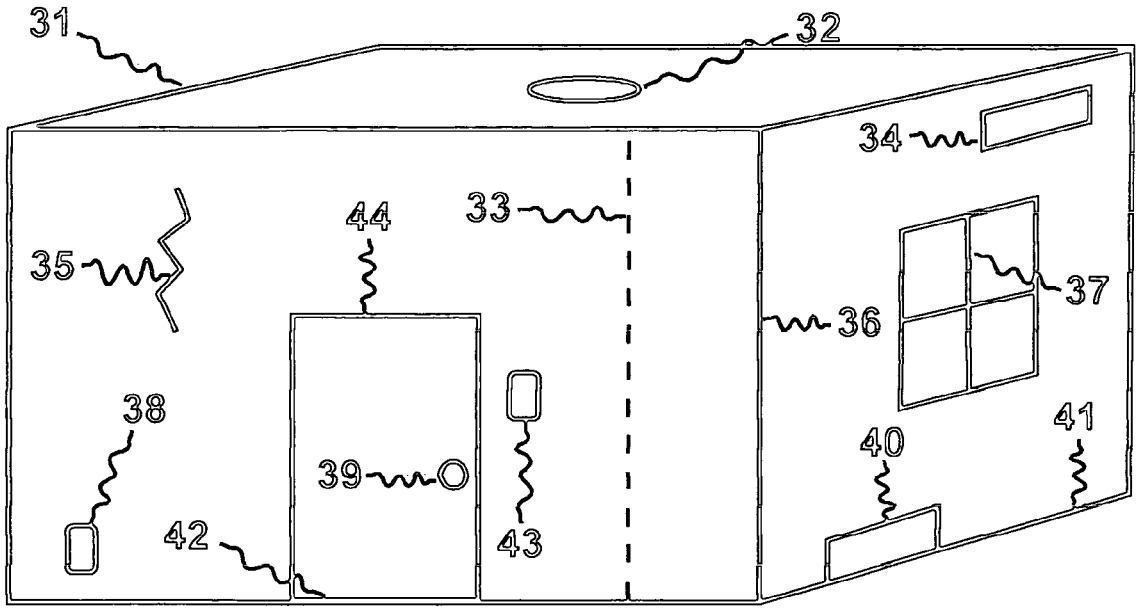

FIG. 1 is a drawing of an enclosed residential or office space illustrating potential points where external air might enter the enclosed space. These potential entry points include (31) joints between the walls and ceiling, (32) ceiling light fixtures, (33) seams between wall panels, (34) ventilation vents, (35) cracks or fissures in the walls, ceiling or floor, (36) joints between walls, (37) windows, (38) electrical outlets, (39) door knobs and latches, (40) heating vents, (41) joints between the walls and the floor, (42) under doors, (43) electrical switches, and (44) around door jams.

Figure 2A:
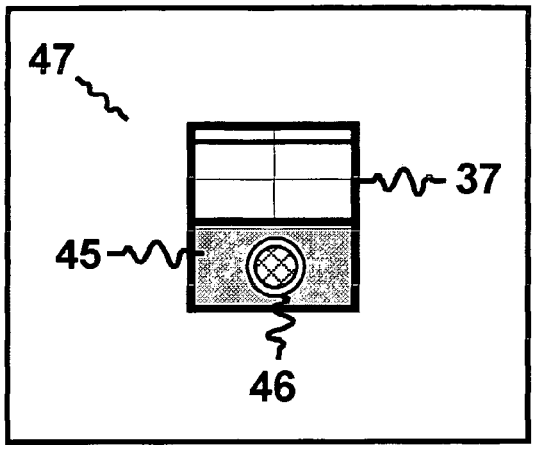

FIG. 2*a* is an exterior view of a room equipped with the room air-cleaner and pressurizing device. The device utilizes the already existing window (37) as the inlet point through the exterior wall (47). Into this window is placed an insert assembly (45). This insert assembly provides an inlet into the room to which a modular filter (46) can be attached. This version of the invention is a portable unit that can be quickly installed into a window (37) as needed.

Figure 2B:
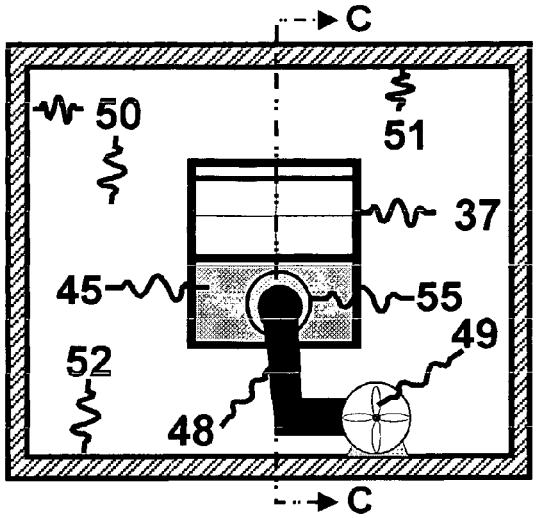

FIG. 2*b* is an interior view of a room equipped with the room air-cleaner and pressurizing device. From this view, the interior elements of the room air-cleaner and pressurizing device can be seen. The room is a typical structure consisting of a ceiling (51), a floor (52), and walls (50). In one wall is a window (37). In the window is placed an insert assembly (45) which contains an air inlet (55). Attached to this air inlet is an air flow conduit (48). This air flow conduit connects the air inlet (55) to a fan (49).

Figure 2C:
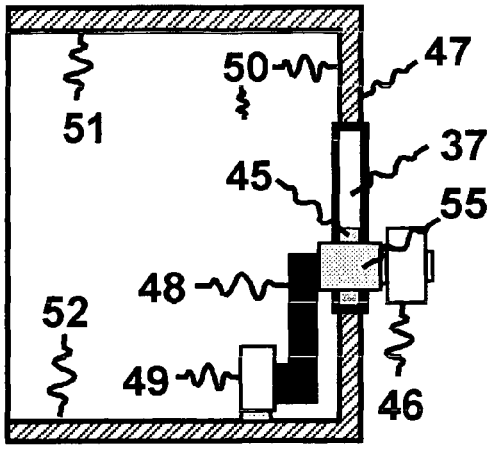

FIG. 2*c* is a sectional view a room equipped with the room air-cleaner and pressurizing device. The room consists of a ceiling (51), floor (52), and walls (50). In one of the walls is a window (37). In this window is placed the insert assembly (45) which contains an air inlet (55). Attached to the outside end of the air inlet (55) is a modular filter (46). Attached to the inside end of the air inlet (55) is an air flow conduit (48). This air flow conduit connects the air inlet (55) to a fan (49).

Figure 3:
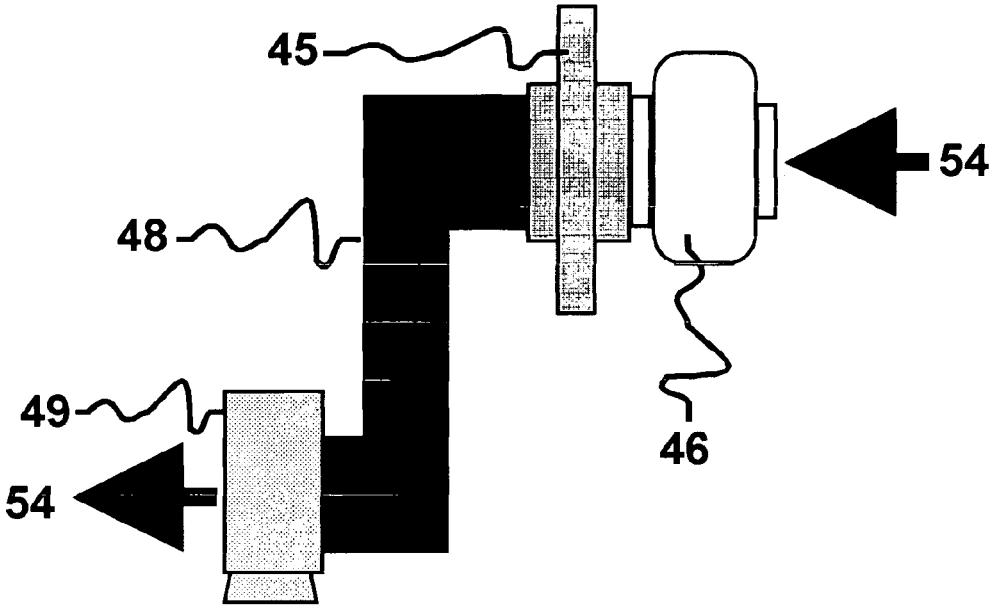
FIG. 3 is a drawing of the room air-cleaner and pressurizing device.

FIG. 3 is a drawing of the room air-cleaner and pressurizing device. The device consists of a modular filter (46), a window insert assembly (45), an airflow conduit (48), and a fan (49). The direction of the air flow into and out of the device is illustrated (54).

Figure 4:
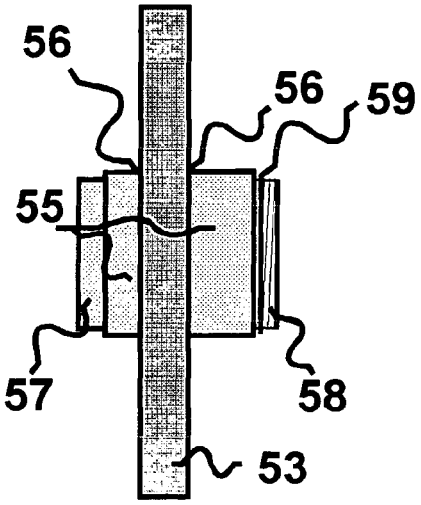
FIG. 4 is a drawing of the window insert assembly of the room air-cleaner and pressurizing device.

FIG. 4 is a drawing of the window insert assembly (45) of the room air-cleaner and pressurizing device. The window insert assembly consists an adjustable panel (53). This panel can be adjusted to fit any window or can be permanently installed in a door, wall, or ceiling. Through this panel is an air inlet (55). The air inlet (55) allows air to flow through the panel. The air inlet (55) is secured in the panel (53) with airtight welds (56). On the room side of the air inlet is an interior coupling (57) designed to accept the airflow conduit (48) depicted in FIG. 3. On the exterior side of the air inlet is a circular male-threaded exterior connector (58) designed to accept the attachment of a filter module (46). The exterior connector fits into the circular female-threaded connector (FIG. 5 (60)) on the filter module (46). A gasket (59) is used to insure an airtight seal between the filter module (46) and the exterior connector (58).

Figure 5:
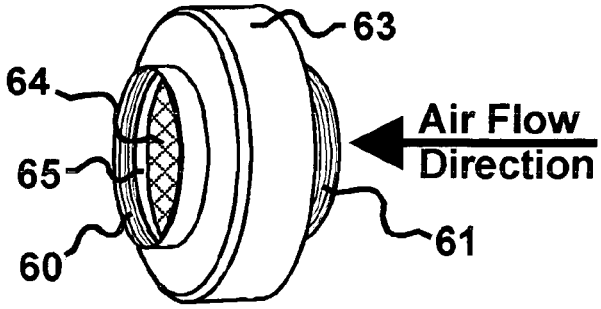
FIG. 5 is a drawing of a filter module used in the room air-cleaner and pressurizing device.

FIG. 5 is a drawing of a filter module. The module is constructed of an airtight housing (63). On one side is a circular outflow vent with a female-threaded connector (60). On the opposite side is a circular inflow vent with a male-threaded connector (61). This allows the filter modules to be attached to the exterior connector (FIG. 4 (58)) on the air inlet (FIG. 4 (55)) of the window insert assembly (FIG. 4). It also allows each filter module to be connected to other filter modules (FIG. 6 (46)). Inside the module are various filter media or mechanisms (64). These are attached to the inside wall of the housing (65) so that the contaminated air cannot bypass the filter media or mechanism. Also, each module is designed so that after use the inflow side can be capped (FIG. 6 (62)) to facilitate the safe disposal of the used filter module.

Figure 6:
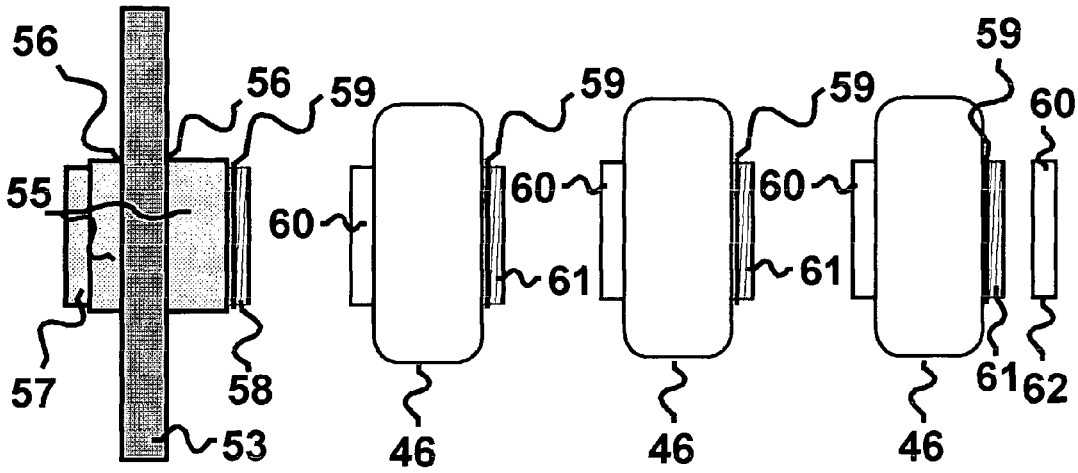
FIG. 6 is a drawing illustrating the arrangement and connection of filter modules to the window insert assembly.

FIG. 6 is a drawing of the filter module(s) (46) and window insert assembly (45) components of the room air-cleaner and pressurizing device. The filter modules (46) are designed so they can be connected to other filter modules. Thus, various filters can be used individually or simultaneously depending on the types and density of the contaminates in the external air. The filter cap (62) is provided so that the contaminated filter module(s) can be closed and safely disposed when the danger has passed.

FIGS. 7*a*, 7*b*, and 7*c* are a views of the fan with a battery backup. The fan is designed to draw air through the inlet connector (69) which is attached to the air flow conduit (FIG. 3 (48)). The air is driven by fan blades (67). The fan blades are driven using an electric motor (66). The housing (68) is used to enclose the fan blades to insure that air is drawn through the inlet connector (69) and the airflow conduit (48) and not simply drawn from the enclosed space. The primary energy source for the electrically driven fan is standard household current (71). In case there is a power failure, a secondary energy source, such as a battery (70), can be incorporated into the system.

Operation—FIGS. 1, 2*c*, 3, 6 and 7*b*

The device is as easy to install as a window air-conditioner. When a terrorist threat is identified, the user simply attaches the appropriate filter module (FIG. 6 (46)) to the air inlet (FIG. 6 (55)) at the exterior connector (FIG. 6 (58)). One or more modules can be attached depending on the threat and expected contaminates. The window insert assembly (FIG. 3 (45)) with the attached modules is placed into the window (FIG. 2*c* (37)) and secured. The panel (FIG. 6 (53)) can be adjusted to the size of the window. The airflow conduit (FIG. 3 (48)) is attached to the window insert assembly at the interior coupling (FIG. 6 (57)). The other end of the airflow conduit is attached to the fan at the fan inlet connector (FIG. 7*b* (69)). The room-air cleaner and pressurizing device is now ready to operate.

Activating the blower or fan draws air from the outside (FIG. 3 (54)) through the modular filters (FIG. 3 (46)) where it is cleaned of any biological, chemical or lethal particles. The cleaned air passes through the window insert assembly (FIG. 3 (45)) by way of the air inlet (FIG. 4 (55)) and along the air flow conduit (FIG. 3 (48)) where it is forced into the enclosed space or room (FIG. 2*c* (50, 51, 52)) by the fan (FIG. 3 (49)). This increases the pressure in the room and provides breathable air for its occupants.

The increased pressure in the room is dissipated from the room through the various cracks, spaces and vents identified in FIG. 1. The outward flow of air from the room prevents contaminated air from entering the room. Various controls can be added to the apparatus to insure the optimal pressure and outflow from the room.

When the threat has passed, the apparatus can be turned off. A cap (FIG. 6 (62)) is placed over the male-threaded connector (FIG. 6 (61)) of the last filter module (FIG. 6 (46)). This seals the contaminates in the filter module(s). The filter module(s) can now be safely detached from the window insert assembly and disposed. The apparatus is now ready to be refitted with new filter modules and re-used.

Each module can be designed for a specific contaminate. In this way, their efficiency and effectiveness against specific contaminates can be maximized. And, because the filter modules can be connected in series, the device can protect against a multitude of threats simultaneously by placing different filter modules in the series.

PREFERRED AND ALTERNATIVE EMBODIMENTS

The preferred embodiment is the window installation describe above. This provides the broadest application of the invention as the device is portable, quickly assembled, and easily installed.

Alternately, the device could be permanently installed in a wall or door. Such a device could be sized large enough to provide multi-room or whole house protection.

Beyond installation, the design of the device suggests other alternatives. For instance, the fan could be mounted directly on the window insert assembly. This would eliminate the air flow conduit (FIG. 3 (48)) which would make the apparatus more compact. Also, the fan could be replaced by a blower or bellows or other means of moving air which, in turn, could be powered by house-hold electric current or a battery or a gas power engine. Still further, the device could be fitted with a complex control system to control the room pressure, monitor oxygen levels and detect any filter failures.

While these additions or alternatives can enhance the operation of the device, they do not significantly change the objective or scope of the invention.

Advantages

From the description above, this invention provides the following:

a) A device that prevents contaminated air from outside an enclosed space from entering that enclosed space by pressurizing the space and turning any potential entry points into exhaust vents.

b) A device that compensates for pressure differentials between the enclosed space to be protected and the exterior environment that is contaminated.

c) A device that protects against several different air-borne contaminate by utilizing a series of modular filters designed to remove different contaminants.

d) A device allows the user to cap the modular filter(s) and safely dispose of the contaminated filter(s) after its use.

e) A device that is economical to purchase and install in an existing enclosed space.

f) A device that is portable and easily moved from one enclosed space to another enclosed space.

g) A device that can be quickly installed in an apartment, office, or home.

h) A device that can be installed by a single resident or occupant without special tools or skills.

Conclusion, Ramifications, and Scope

Accordingly, this invention provides home owners and apartment dwellers with a means to establish a pressurized clean-room as a defense against air-borne contaminates. These contaminates can be unleashed by nature, human error or terrorist attack. They include, but are not limited to, chemical, biological or radioactive agents.

The preferred embodiment of the invention is portable, easy to set up and can be quickly installed in an existing window.

It is designed to defend against multiple contaminates. It is easy to maintain. And the contaminated filtering modules of the device can be safely disposed of after use.

The device can be sized to any room and any number of occupants. It can be equipped with various control systems to insure optimum effectiveness. Or it can be simplified to reduce cost and make it more affordable.

Or, as an alternative, it can be permanently installed into a wall, ceiling or onto an exterior cement pad like a central air-conditioner.

Although the description above contains many specifics, these should not be construed as limiting the scope of the invention but as merely providing illustrations of some of the presently preferred embodiments of the invention. For example, the device could be powered by an electric motor, a gas powered motor or a mechanical crank. These alternate powering methods do not alter the basic objective and scope of the invention.

Thus, the scope of the invention should be determined by the appended claims and their legal equivalents, rather than the examples given.

I claim:

1. A portable air cleaning and air transportation device sandwiching an existing enclosed space and the ambient air outside said existing enclosed space, said existing enclosed space being sufficiently large for habitation by at least one human, such that said portable air cleaning and air transportation device can remove contaminants from and neutralize contaminants in said ambient air and transport the cleaned and neutralized ambient air into said existing enclosed space in sufficient quantities to increase the air pressure and maintain a habitable environment within said existing enclosed place, said portable air cleaning and air transportation device comprising:

a) at least one modular air filtering device disposed outside said existing enclosed space in said ambient air, said modular air filtering device comprising an air cleaning means surrounded by an air tight housing, said air tight housing having an air inlet disposed on one side of said air cleaning means and an air outlet disposed on the opposite side of said air cleaning means such that said ambient air enters said modular air filtering device at said air inlet and passes through said air cleaning means to said air outlet; and b) a means for connecting said air outlet of one said modular air filtering device to said air inlet of another said modular air filtering device thereby creating a contiguous plurality of said modular air filtering devices in fluid communication one with the other; and c) a means for closing said air inlet of said air tight housing of said modular air filtering device such that said contaminants removed by said air cleaning means cannot exit said air inlet of said modular air filtering device subsequent to use and during the disposal thereof; and d) a device for pulling said ambient air into and through at least one said modular air filtering device and transporting said cleaned and neutralized ambient air from said air outlet of at least one said modular air filtering device into said existing enclosed space, said device for pulling said ambient air being disposed within said existing enclosed space and comprising an air tight housing, said air tight housing having a housing air inlet, a housing air outlet, and a means for moving air within said air tight housing sandwiching said housing air inlet and said housing air outlet; and e) a means for maintaining fluid communication between said housing air inlet of said device for pulling ambient air and said air outlet of at least one said modular air filtering device, said means for maintaining fluid communication sandwiching said housing air inlet of said device for pulling ambient air and said air outlet of at least one said modular air filtering device, said means for maintaining fluid communication comprising an air inlet for transporting said cleaned and neutralized ambient air and an adjustable panel surrounding and permanently affixed to said air inlet such that said air inlet and said adjustable panel can be quickly and easily inserted and fitted into an existing access of said existing enclosed space such that said means for maintaining fluid communication maintains a separation between said existing enclosed space and said ambient air outside said existing enclosed space; and f) a means for affixing said air inlet of said means for maintaining fluid communication to said air outlet of said modular air filtering device and a means for affixing said air inlet of said means for maintaining fluid communication to said air inlet of said device for pulling said ambient air such that said modular air filtering device and said device for pulling said ambient air can be easily and quickly connected to and unconnected from said air inlet of said means for maintaining fluid communication.

2. The portable air cleaning and transportation device of claim 1 wherein said existing enclosed space is at least one room of a home or building.

3. The portable air cleaning and transportation device claimed in claim 1 wherein said existing access to said existing enclosed space is a window.

4. The portable air cleaning and transportation device claimed in claim 1 wherein said means for moving air is an electric powered fan.

5. The portable air cleaning and transportation device claimed in claim 1 wherein said means for connecting said air outlet of one said modular air filtering device to said air inlet of another said modular air filtering device is a circular threaded member such that said modular air filtering devices can be easily and quickly assembled into said plurality of said modular air filtering devices.

6. The portable air cleaning and transportation device claimed in claim 1 wherein said means for affixing said air inlet of said means for maintaining fluid communication to said air outlet of said modular air filtering device is a circular threaded member such that said contiguous plurality of said modular air filtering devices can be easily and quickly affixed to and detached from said air inlet of said means for maintaining fluid communication.

7. The portable air cleaning and transportation device claimed in claim 1 wherein said means for affixing said air inlet of said means for maintaining fluid communication to said air inlet of said device for pulling said ambient air is an unthreaded member such that said device for pulling said ambient air can be easily and quickly affixed to and detached from said air inlet of said means for maintaining fluid communication.

8. The portable air cleaning and transportation device claimed in claim 1 wherein said means for closing said air inlet of said air tight housing of said modular air filtering device is an air impermeable circular threaded cap.

9. The portable air cleaning and transportation device claimed in claim 1 wherein said contaminants in said ambient air are of the type that would be released into said ambient air during a terrorist attack, an industrial accident or a natural disaster, said contaminants including particulate, chemical, biological and radioactive materials.

* * * * *